US005457931A

United States Patent [19]

Kurata et al.

[11] Patent Number: 5,457,931

[45] Date of Patent: Oct. 17, 1995

[54] COIN WRAPPING APPARATUS

[75] Inventors: Tadao Kurata, Saitama; Takashi Shinozaki, Chiba, both of Japan

[73] Assignee: Laurel Bank Machines Co., Ltd., Tokyo, Japan

[21] Appl. No.: 191,541

[22] Filed: Feb. 4, 1994

[30] Foreign Application Priority Data

Feb. 17, 1993 [JP] Japan ..... 5-014239 U
Dec. 27, 1993 [JP] Japan ..... 5-331075

[51] Int. Cl.[6] ..... B65B 49/00; B65B 11/04

[52] U.S. Cl. ..... 53/212

[58] Field of Search ..... 53/211, 212, 213, 53/214, 215; 475/89.15, 424.8 R

[56] References Cited

U.S. PATENT DOCUMENTS

| | | | |
|---|---|---|---|
| 3,863,425 | 2/1975 | Edwards et al. | 53/211 |
| 4,123,892 | 11/1978 | Asami | 53/212 |
| 4,219,985 | 9/1980 | Uchida et al. . | |
| 4,409,776 | 10/1983 | Usui | 53/211 |
| 4,435,992 | 3/1984 | Berthold | 74/89.15 |
| 4,677,811 | 7/1987 | Brisebarre . | |
| 4,729,211 | 3/1988 | Sakurai | 53/212 |

FOREIGN PATENT DOCUMENTS

| | | |
|---|---|---|
| 432675 | 6/1991 | European Pat. Off. . |
| 54-31382 | 3/1979 | Japan . |
| 2076373 | 12/1981 | United Kingdom . |

*Primary Examiner*—John Sipos
*Assistant Examiner*—Rodney Butler
*Attorney, Agent, or Firm*—Cushman, Darby & Cushman

[57] ABSTRACT

A coin wrapping apparatus including a coin support member moving mechanism for moving a coin support member adapted to support coins stacked, a wrapping roller moving mechanism for moving a plurality of wrapping rollers adapted to wind a wrapping film around the stacked coins supported by the coin support member and a crimp claw moving mechanism for moving a pair of crimp claws adapted to crimp upper and lower end portions of the wrapping film wound around the stacked coins by the wrapping rollers and produce a wrapped coin roll having a predetermined number of coins, the coin support member moving mechanism including a first coin support moving member for moving the coin support member vertically, a second coin support moving member for moving the coin support member horizontally, the first and second coin support moving members being selectively actuated, the crimp claw moving mechanism including a first crimp claw moving member for moving the pair of crimp claws vertically, a second crimp claw moving member for moving the pair of crimp claws horizontally, the first and second crimp claw moving members being selectively actuated, the wrapping roller moving mechanism including a rotatable shaft formed with an external thread and a wrapping roller spacing adjusting member having a bore whose inner surface is formed with an internal thread which can engage with the external thread on the rotatable shaft for moving the wrapping roller spacing adjusting member along the rotatable shaft as the rotatable shaft rotates and links for moving the plurality of wrapping rollers in accordance with the movement of the wrapping roller spacing adjusting member along the rotatable shaft. The thus constituted coin wrapping apparatus can be made compact and can wrap a predetermined number of coins in a desired manner with a mechanism of simple structure.

19 Claims, 10 Drawing Sheets

COIN WRAPPING APPARATUS

BACKGROUND OF THE INVENTION

The present invention relates to a coin wrapping apparatus for wrapping a predetermined number of coins and, in particular, to a compact coin wrapping apparatus which wraps a predetermined number of coins in a desired manner with a mechanism of simple structure.

DESCRIPTION OF THE PRIOR ART

A coin wrapping machine generally includes a coin stacking apparatus for stacking a predetermined number of coins in a roll-like manner and a coin wrapping apparatus comprising three wrapping rollers for winding a wrapping film such a paper, a transparent or semitransparent plastic film or the like around the coins stacked by the coin stacking apparatus, a coin support means for receiving the stacked coins from the coin stacking apparatus and transferring them to between the three wrapping rollers and an upper crimp claw and a lower crimp claw for crimping the upper portion and the lower portion of the wrapping film wound around the stacked coins.

Because the coin diameter differs depending upon the denomination of the coins to be wrapped, the coin wrapping apparatus is provided with a cam mechanism and a link mechanism for moving the three wrapping rollers and the pair of crimp claws in accordance with the denominations of coins to be wrapped.

For example, U.S. Pat. No. 4,219,985 discloses a coin wrapping apparatus including a wrapping roller moving mechanism having cams for retracting three wrapping rollers which are biased by springs so as to come up to each other to their retracted positions and cams for adjusting the retracted positions of the three wrapping rollers depending upon the denominations of coins to be wrapped, a coin support means moving mechanism having cams for moving a coin support means between its waiting position immediately below the coin stacking apparatus and its wrapping position where the stacked coins are wrapped by the wrapping rollers and cams for moving the coin support means between its wrapping position between the three wrapping rollers and its retracted position apart from the space between the three wrapping rollers, a crimping claw moving mechanism having cams for moving an upper crimp claw and a lower crimp claw between their retracted positions and their waiting positions above or below the space between the three wrapping rollers and cams for moving the upper crimp claw and the lower crimp claw between their waiting positions and their crimping positions where the upper and lower portions of a wrapping film are crimped, and link mechanisms for transmitting forces from the respective cams.

However, the thus constituted coin wrapping apparatus has a lot of cams and, correspondingly, a lot of link mechanisms and, therefore, inevitably becomes large.

SUMMARY OF THE INVENTION

It is therefore an object of the present invention to provide a compact coin wrapping apparatus which can wrap a predetermined number of coins in a desired manner with a mechanism of simple structure.

The above and other objects of the present invention can be accomplished by a coin wrapping apparatus comprising a coin support member moving mechanism for moving a coin support member adapted to support coins stacked by a coin stacking apparatus, a wrapping roller moving mechanism for moving a plurality of wrapping rollers adapted to wind a wrapping film around the stacked coins supported by the coin support member and a crimp claw moving mechanism for moving a pair of crimp claws adapted to crimp upper and lower end portions of the wrapping film wound around the stacked coins by the plurality of wrapping rollers and produce a wrapped coin roll having a predetermined number of coins. The coin support member moving mechanism comprises a first coin support member moving means for moving the coin support member vertically, a second coin support member moving means for moving the coin support member horizontally and a first switching means for selectively actuating the first coin support member moving means and the second coin support member moving means. The crimp claw moving mechanism comprises a first crimp claw moving means for moving the pair of crimp claws vertically, a second crimp claw moving means for moving the pair of crimp claws horizontally and a second switching means for selectively actuating the first crimp claw moving means and the second crimp claw moving means. The wrapping roller moving mechanism comprises a rotatable shaft formed with an external thread, a wrapping roller spacing adjusting means having a bore whose inner surface is formed with an internal thread which can engage with the external thread on the rotatable shaft for moving the wrapping roller spacing adjusting means along the rotatable shaft as the rotatable shaft rotates and link means for moving the plurality of wrapping rollers in accordance with the movement of the wrapping roller spacing adjusting means along the rotatable shaft.

In a preferred aspect of the present invention, the coin support member moving mechanism comprises a coin support arm member having a bore whose inner surface is formed with an internal thread and the coin support member formed on one end portion thereof, the first coin support member moving means comprises a rotatable shaft formed with an external thread which can engage with the internal thread of the coin support arm member and the second coin support member moving means comprises swing means swingable about the rotatable shaft together with the coin support arm member so that the first switching means selectively swings the swing means to move the coin support arm member horizontally or rotates the rotatable shaft to move the coin support arm member vertically.

In another preferred aspect of the present invention, the crimp claw moving mechanism comprises an upper crimp claw arm member having a bore whose inner surface is formed with an internal thread and an upper crimp claw formed at one end portion thereof and a lower crimp claw arm member having a bore whose inner surface is formed with an internal thread and a lower crimp claw formed at one end portion thereof, the first crimp claw moving means comprises a rotatable shaft formed with an external thread which can engage with the internal threads of the upper crimp claw arm member and the lower crimp claw arm member, and which is opposite in helical directions between the upper and lower portions thereof, and the second crimp claw moving means comprises a swing member swingable about the rotatable shaft together with the upper crimp claw arm member and the lower crimp claw arm member so that the second switching means selectively swings the swing means to move the upper crimp claw arm member and the lower crimp claw arm member horizontally or rotates the rotatable shaft to move the upper crimp claw arm member and the lower crimp claw arm member vertically.

In a further preferred aspect of the present invention, the first switching means comprises a planetary gear mechanism.

In another preferred aspect of the present invention, the second switching means comprises a planetary gear mechanism.

In a further preferred aspect of the present invention, the first switching means comprises clutch means and brake means.

In a further preferred aspect of the present invention, the second switching means comprises clutch means and brake means.

In a still further preferred aspect of the present invention, the coin wrapping apparatus further comprises guide means for guiding the wrapping roller spacing adjusting means along the rotatable shaft.

In a yet further preferred aspect of the present invention, the first coin support member moving means comprises an endless driving force transmitting means for moving the coin support arm member vertically.

In a further preferred aspect of the present invention, the first crimp claw moving means comprises an endless driving force transmitting means for moving the upper crimp claw arm member and the lower crimp claw arm member vertically.

The above and other objects and features of the present invention will become apparent from the following description made with reference to the accompanying drawings.

DESCRIPTION OF THE PREFERRED EMBODIMENTS

Figure 1:
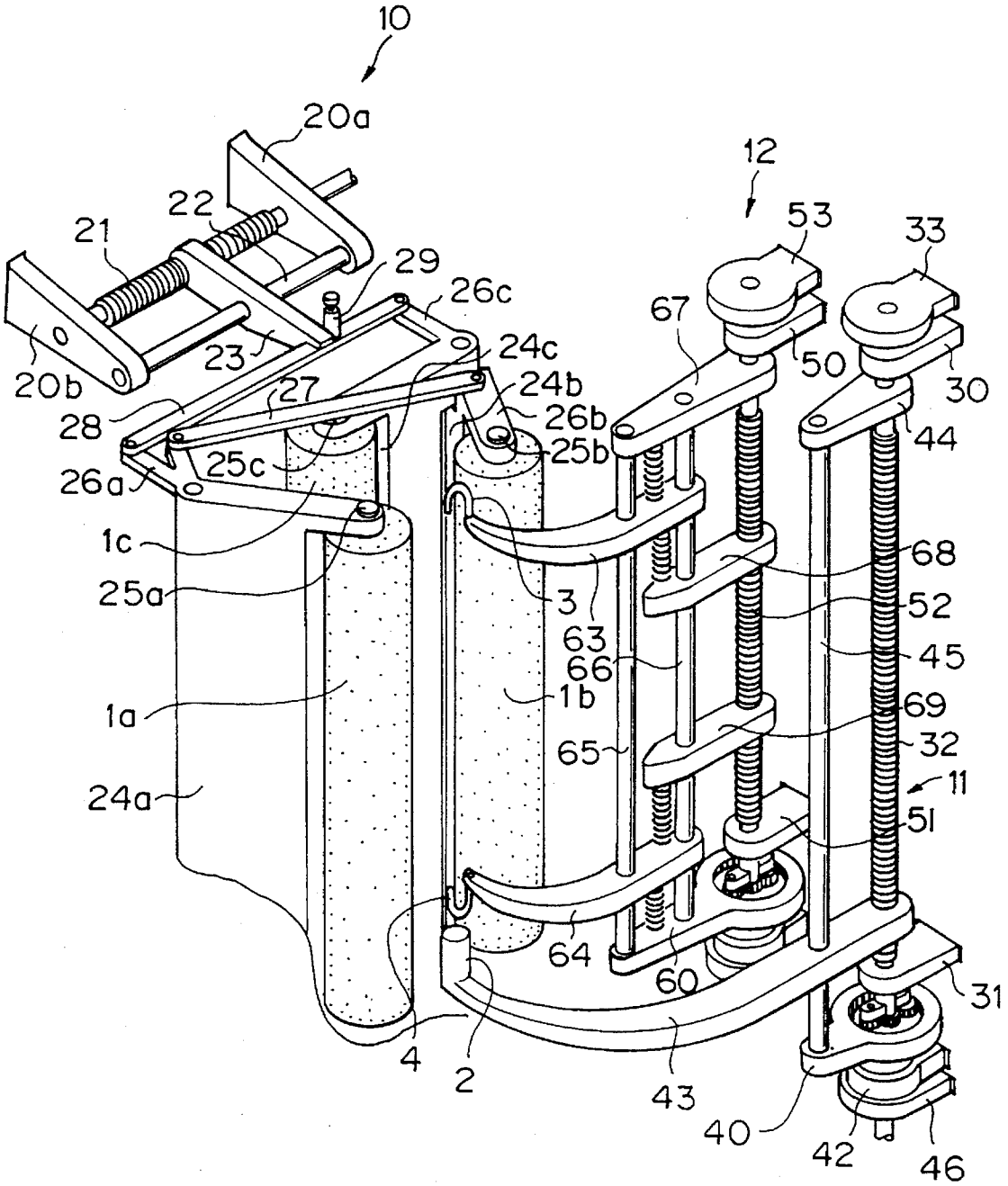
FIG. 1 is a schematic perspective view of a coin wrapping apparatus according to an embodiment of the present invention.

Referring to FIG. 1, a coin wrapping apparatus which is an embodiment of the present invention includes three wrapping rollers 1*a*, 1*b*, 1*c* for wrapping a predetermined number of coins stacked by a coin stacking apparatus (not shown) by winding a wrapping film (not shown) around them, a coin support post 2 for receiving the coins stacked by the coin stacking apparatus and supporting them on the upper surface thereof and an upper crimp claw 3 and a lower crimp claw 4 for crimping the upper and lower end portions of the wrapping film wound around the stacked coins supported by the coin support post 2 and producing a wrapped coin roll containing a predetermined number of coins.

Further, the coin wrapping apparatus includes a wrapping roller moving mechanism 10 for moving the wrapping rollers 1*a*, 1*b*, 1*c*, a coin support post moving mechanism 11 for moving the coin support post 2 and a crimp claw moving mechanism 12 for moving the upper crimp claw 3 and the lower crimp claw 4.

The wrapping roller moving mechanism 10 is adapted for moving the wrapping rollers 1*a*, 1*b*, 1*c* between wrapping roller wrapping positions where the wrapping rollers 1*a*, 1*b*, 1*c* hold the stacked coins to be wrapped therebetween and wind the wrapping film around the stacked coins, wrapping roller retracted positions where the wrapping rollers 1*a*, 1*b*, 1*c* are apart from each other and wrapping roller waiting positions where the wrapping rollers 1*a*, 1*b*, 1*c* stand by. The wrapping roller wrapping positions and the wrapping roller waiting positions are determined in accordance with the denominations of the coins to be wrapped.

The coin support post moving mechanism 11 is adapted for moving the coin support post 2 between a coin support post waiting position immediately below the coin stacking apparatus where the coin support post 2 receives the coins stacked by the coin stacking apparatus, a coin support post wrapping position between the wrapping rollers 1*a*, 1*b*, 1*c* where the stacked coins are held on the upper surface of the coin support post 2 and the wrapping film is wound therearound and a coin support post retracted position where the coin support post 2 is retracted from the space between the wrapping rollers 1*a*, 1*b*, 1*c*.

The crimp claw moving mechanism 12 is adapted moving the upper crimp claw 3 and the lower crimp claw 4 between crimp claw retracted positions where the upper crimp claw 3 and the lower crimp claw 4 are retracted from upper and lower locations above and below the space between the wrapping rollers 1*a*, 1*b*, 1*c*, crimp claw waiting positions above and below the space between the wrapping rollers 1*a*, 1*b*, 1*c* and crimping positions where the upper crimp claw 3 and the lower crimp claw 4 can crimp the upper and lower end portions of the wrapping film wound around the stacked coins by the wrapping rollers 1*a*, 1*b*, 1*c*. The crimping positions and the crimp claw waiting positions are determined in accordance with the denominations of the coins to be wrapped.

The wrapping roller moving mechanism 10 includes a pair of arms 20*a*, 20*b* each having one end fixed to the body (not shown) of the coin wrapping apparatus, a rotatable shaft 21 rotatably supported by the pair of arms 20*a*, 20*b*, a guide rod 22 fixed to the arms 20*a*, 20*b*, and a wrapping roller spacing adjusting member 23 having two bores. The guide rod 22 is fitted into one of the bores of the wrapping roller spacing adjusting member 23 and the inner wall of the other bore is formed with an internal thread. The surface of the rotatable shaft 21 is formed with an external thread which engages with the internal thread in the associated bore of the wrapping roller spacing adjusting member 23. A motor (not shown) is connected to one end portion of the rotatable shaft 21.

The wrapping rollers 1*a*, 1*b*, 1*c* are respectively supported by wrapping roller support members 24*a*, 24*b*, 24*c* so as to be rotatable about shafts 25*a*, 25*b*, 25*c*. A fork-like link 26*a* extends from the wrapping roller support member 24*a*, a link 26*b* extends from the wrapping roller support member 24*b* and a link 26*c* extends from the wrapping roller support member 24*c*. A link 27 is secured between one bifurcated end portion of the fork-like link 26*a* and the distal end portion of the link 26*b* and a link 28 is secured between the other bifurcated end portion of the fork-like link 26*a* and the distal end portion of the link 26*c*.

A pin 29 biased to the left in FIG. 1 by a tension spring (not shown) is fixed to the link 28 and the end portion of the wrapping roller spacing adjusting member 23 abuts against the pin 29. Consequently, the wrapping rollers 1*a*, 1*b*, 1*c* are biased toward each other.

According to the thus constituted wrapping roller moving mechanism 10, when the motor is driven so as to rotate the rotatable shaft 21, the wrapping roller spacing adjusting member 23 is moved horizontally and, as a result, the spacing between the wrapping rollers 1*a*, 1*b*, 1*c* can be adjusted in a desired manner via the links 28, 26*a*, 27, 26*b*, 26*c*.

Figure 2:
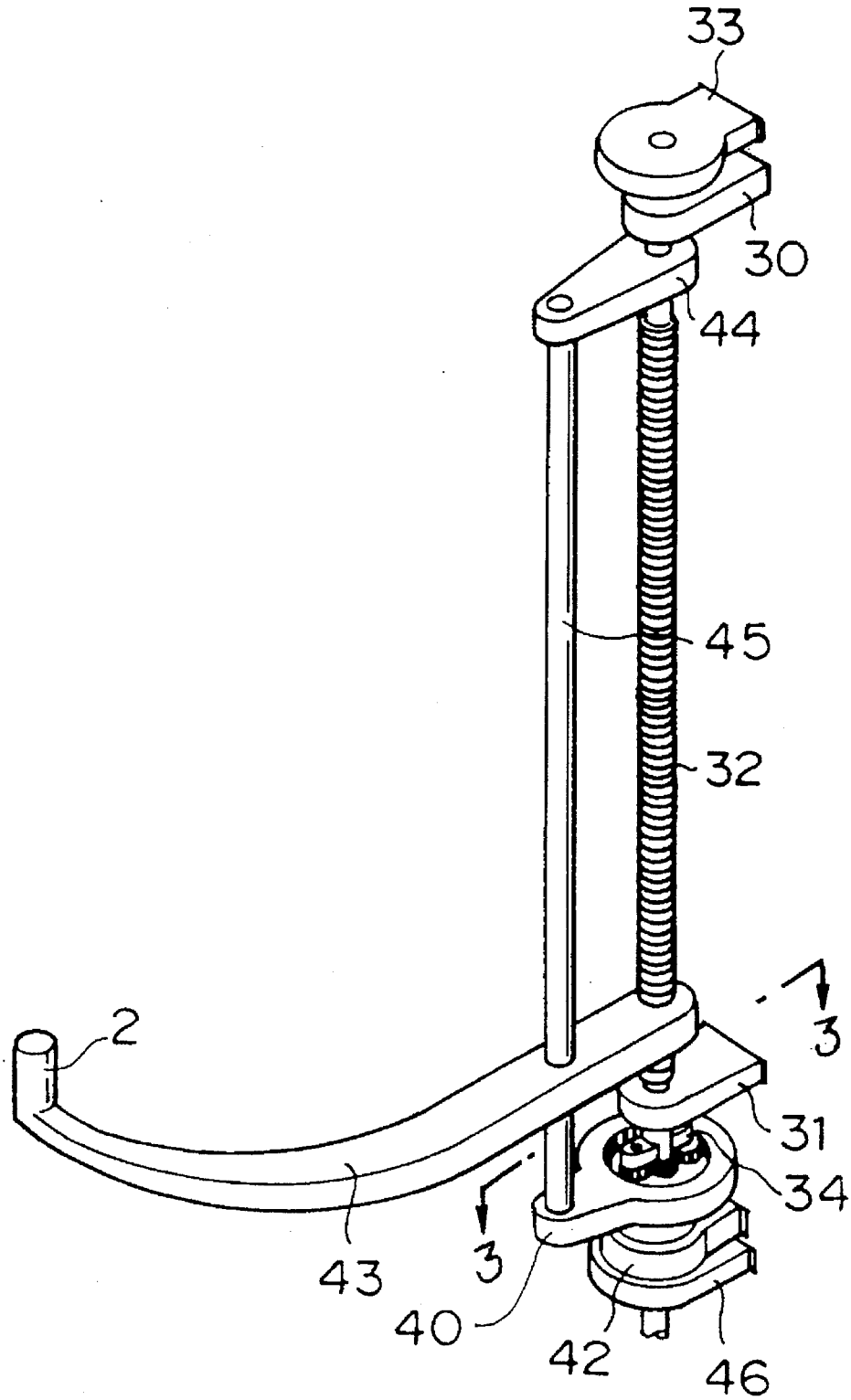
FIG. 2 is a schematic perspective view showing in detail a coin support post moving mechanism of the coin wrapping apparatus.
Figure 3:
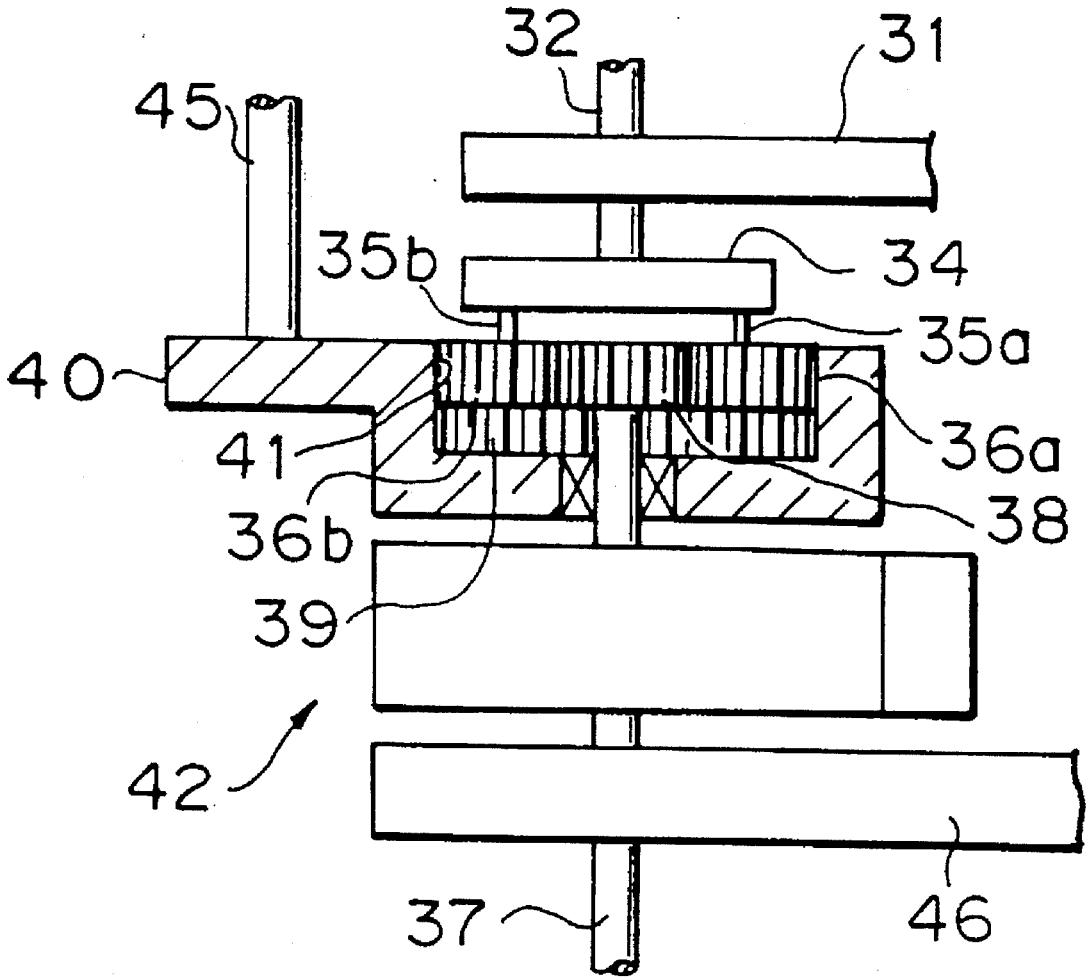
FIG. 3 is a schematic cross sectional view taken along line 3—3 in FIG. 2.

FIG. 2 is a schematic perspective view showing the coin support post moving mechanism in detail and FIG. 3 is a schematic cross sectional view taken along line 3—3 in FIG. 2.

As shown FIGS. 2 and 3, the coin support post moving mechanism 11 includes a rotatable shaft 32 rotatably supported by support frames 30, 31 fixed to the body of the coin wrapping apparatus. An electromagnetic brake 33 is secured to the upper end portion of the rotatable shaft 32 projecting upwardly from the frame 30 and the central portion of an arm 34 extending horizontally is secured to the lower end portion of the rotatable shaft 32 projecting downwardly from the frame 31. Shafts 35*a*, 35*b* are fixed to opposite end portions of the arm 34 and planetary gears 36*a*, 36*b* are rotatably supported by the shafts 35*a*, 35*b*.

Below the arm 34, a sun gear 38 is connected to a drive shaft 37 extending coaxially with the rotatable shaft 32. The drive shaft 37 is connected to the output shaft of a motor (not shown) via an electromagnetic clutch (not shown) and the sun gear 38 meshes with the planetary gears 36*a*, 36*b*.

The drive shaft 37 rotatably supports an arm 40 formed with a recess portion 39 and the inner wall of the recess portion 39 is formed with an internal gear 41 meshing the planetary gears 36*a*, 36*b*. The arm 40 is provided with an electromagnetic brake 42 for braking the swinging movement of the arm 40 about the drive shaft 37.

Further, the coin support post 2 is formed on one end portion of a coin support post arm 43. A guide rod 45 fixed between the arm 40 and an arm 44 passes through one of two bores formed in the arm 43. The surface of the rotatable shaft 32 is formed with an external thread. The inner wall of the other bore of the coin support post arm 43 is formed with an internal thread which engages with the external thread on the surface of the rotatable shaft 32. The upper portion of the rotatable shaft 32, which is not formed with a thread passes through the arm 44.

In FIGS. 2 and 3, the reference numeral 46 designates a support frame fixed to the body of the coin wrapping apparatus.

Figure 4:
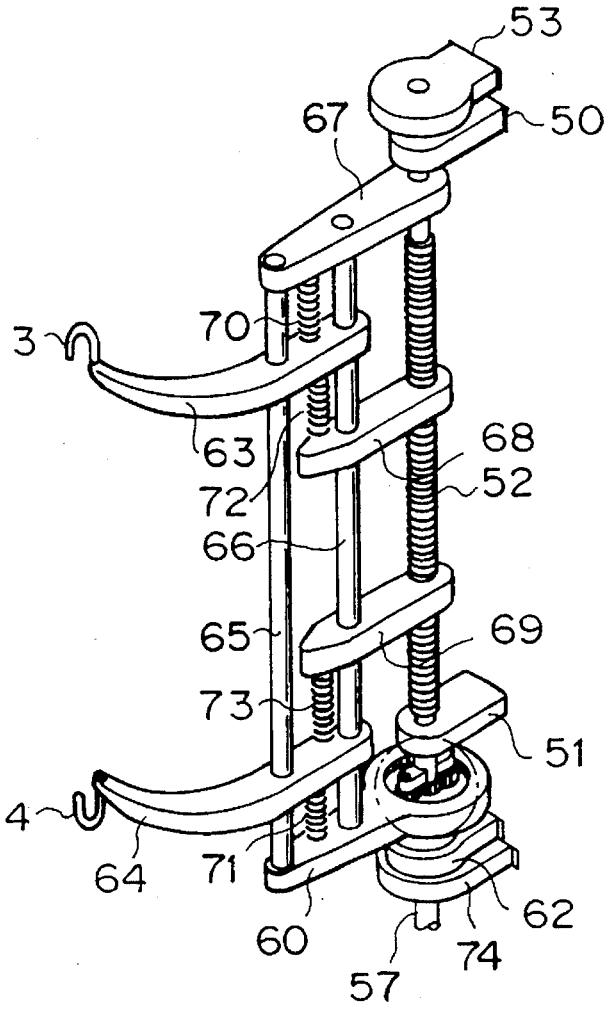
FIG. 4 is a schematic perspective view showing in detail a crimp claw moving mechanism of the coin wrapping apparatus.
Figure 5:
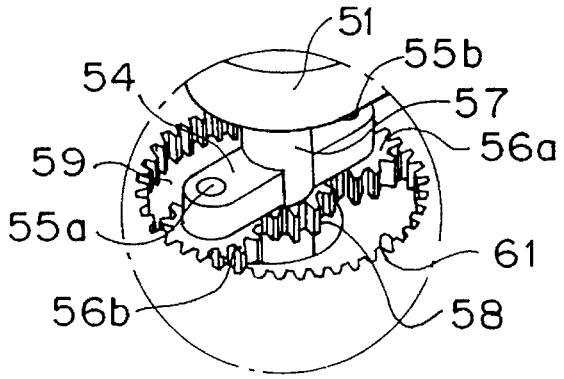
FIG. 5 is a schematic drawing showing an enlarged perspective view of a part of FIG. 4.

FIG. 4 is a schematic perspective view showing the crimp claw moving mechanism in detail and FIG. 5 is a schematic drawing showing an enlarged perspective view of a part of the crimp claw moving mechanism.

As shown in FIGS. 4 and 5, the crimp claw moving mechanism 12 includes a rotatable shaft 52 rotatably supported by support frames 50, 51 fixed to the body of the coin wrapping apparatus. An electromagnetic brake 53 is secured to the upper end portion of the rotatable shaft 52 projecting upwardly from the frame 50 and the central portion of a horizontally extending arm 54 is secured to the lower end portion of the rotatable shaft 52 projecting downwardly from the frame 51. Shafts 55*a*, 55*b* are fixed to opposite end portions of the arm 54 and planetary gears 56*a*, 56*b* are rotatably supported by the shafts 55*a*, 55*b*.

Below the arm 54, a sun gear 58 is connected to a drive shaft 57 extending coaxially with the rotatable shaft 52. The drive shaft 57 is connected to the output shaft of a motor (not shown) via an electromagnetic clutch (not shown) and the sun gear 58 meshes with the planetary gears 56*a*, 56*b*.

The drive shaft 57 rotatably supports an arm 60 formed with a recess portion 59 and the inner wall of the recess portion 59 is formed with an internal gear 61 meshing the planetary gears 56*a*, 56*b*. The arm 60 is provided with an electromagnetic brake 62 for braking the swinging movement of the arm 60 about the drive shaft 57.

Further, an upper crimp claw arm 63 is provided at its distal end with the upper crimp claw 3 and a lower crimp claw arm 64 is provided at its distal end with the lower crimp claw 4. Each of the upper crimp claw arm 63 and the lower crimp claw arm 64 is formed with two bores through which guide rods 65, 66 are passed. The opposite end portions of the guide rods 65, 66 are fixed to the arm 60 and an arm 67.

The surface of the rotatable shaft 52 is formed with an external thread whose helical direction reverses at the longitudinal center portion of the rotatable shaft 52. A pair of elevator members 68, 69 are provided. Each of a pair of elevator members 68, 69, each of which has two bores, has the guide rod 66 passing through one of its bores and has the inner wall of the other bore formed with an internal thread which engages with the external thread formed on the rotatable shaft 52. A tension spring 70 is mounted between the arm 67 and the upper crimp claw arm 63 and a tension spring 71 is mounted between the arm 60 and the lower crimp claw arm 64. Further, a tension spring 72 is mounted between the upper crimp claw arm 63 and the elevator member 68 and a tension spring 73 is mounted between the lower crimp claw arm 64 and the elevator member 69. The upper portion of the rotatable shaft 52, which is not formed with a thread passes through the arm 67.

In FIG. 4, the reference numeral 74 designates a support frame fixed to the body of the coin wrapping apparatus.

Figure 6:
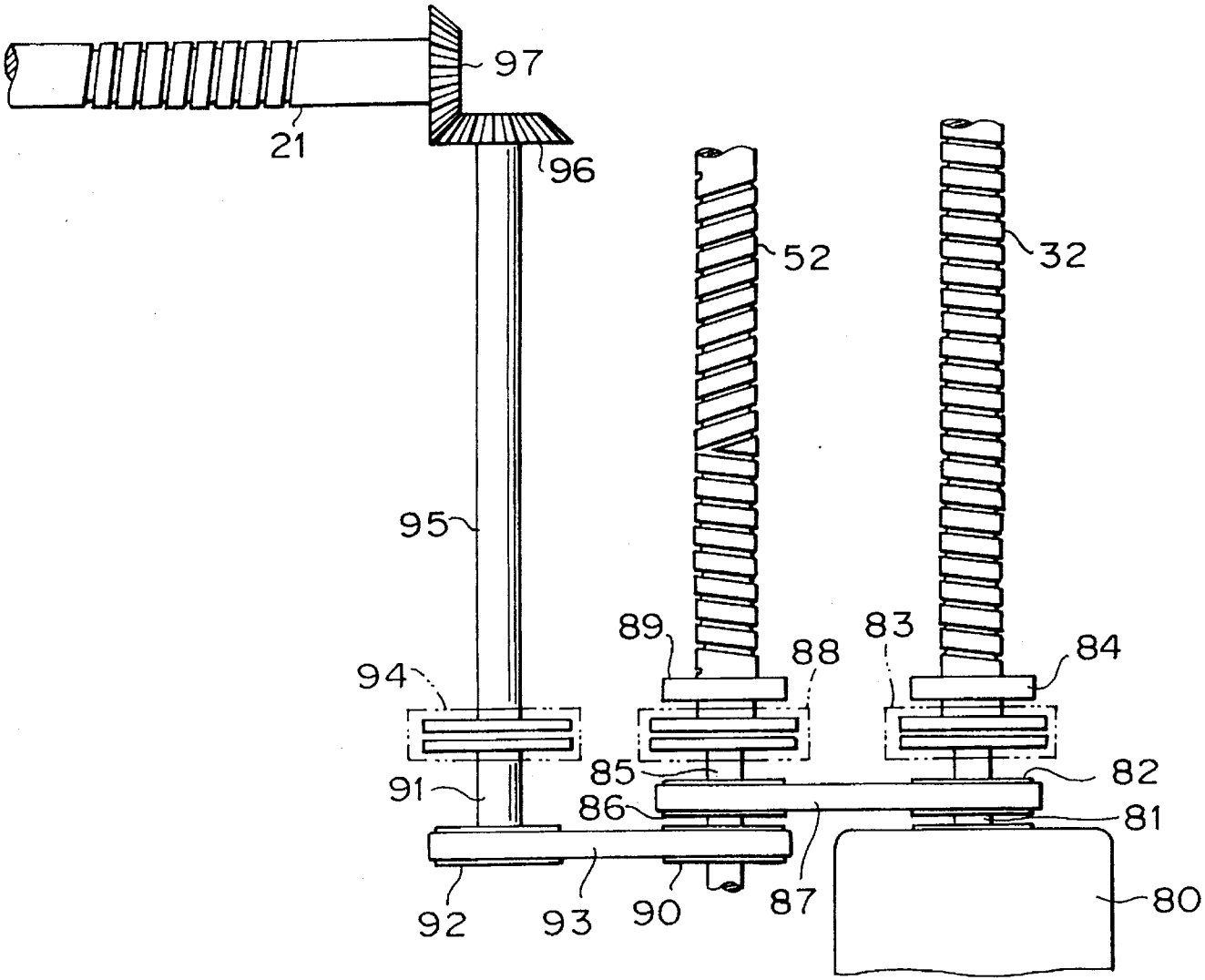
FIG. 6 is a schematic front view showing a drive mechanism of a coin wrapping apparatus which is an embodiment of the present invention.

FIG. 6 is a schematic front view showing a drive mechanism of a coin wrapping apparatus which is an embodiment of the present invention.

In FIG. 6, a pulley 82 is fixed to the output shaft 81 of a motor 80 and the output shaft 81 is connected to the drive shaft 37 via an electromagnetic clutch 83. A driving force transmitting mechanism 84 is connected to the drive shaft 37. The driving force transmitting mechanism 84 comprises the arm 34, the planetary gears 36a, 36b, the sun gear 38, the arm 40, the internal gear 41 and the electromagnetic brake 42. A belt 87 is wrapped around the pulley 82 and a pulley 86 fixed to a shaft 85. The shaft 85 is connected to the drive shaft 57 via an electromagnetic clutch 88. A driving force transmitting mechanism 89 is connected to the drive shaft 57. The driving force transmitting mechanism 89 comprises the arm 54, the planetary gears 56a, 56b, the sun gear 58, the arm 60, the internal gear 61 and the electromagnetic brake 62. A belt 93 is wrapped around a pulley 90 fixed to the shaft 85 and a pulley 92 fixed to a shaft 91 and the shaft 91 is connected to a drive shaft 95 via an electromagnetic brake 94. A bevel gear 96 is provided at the end portion of the drive shaft 95 so that the driving force of the drive shaft 95 can be transmitted to the rotatable shaft 21 via a bevel gear 97.

Figure 7:
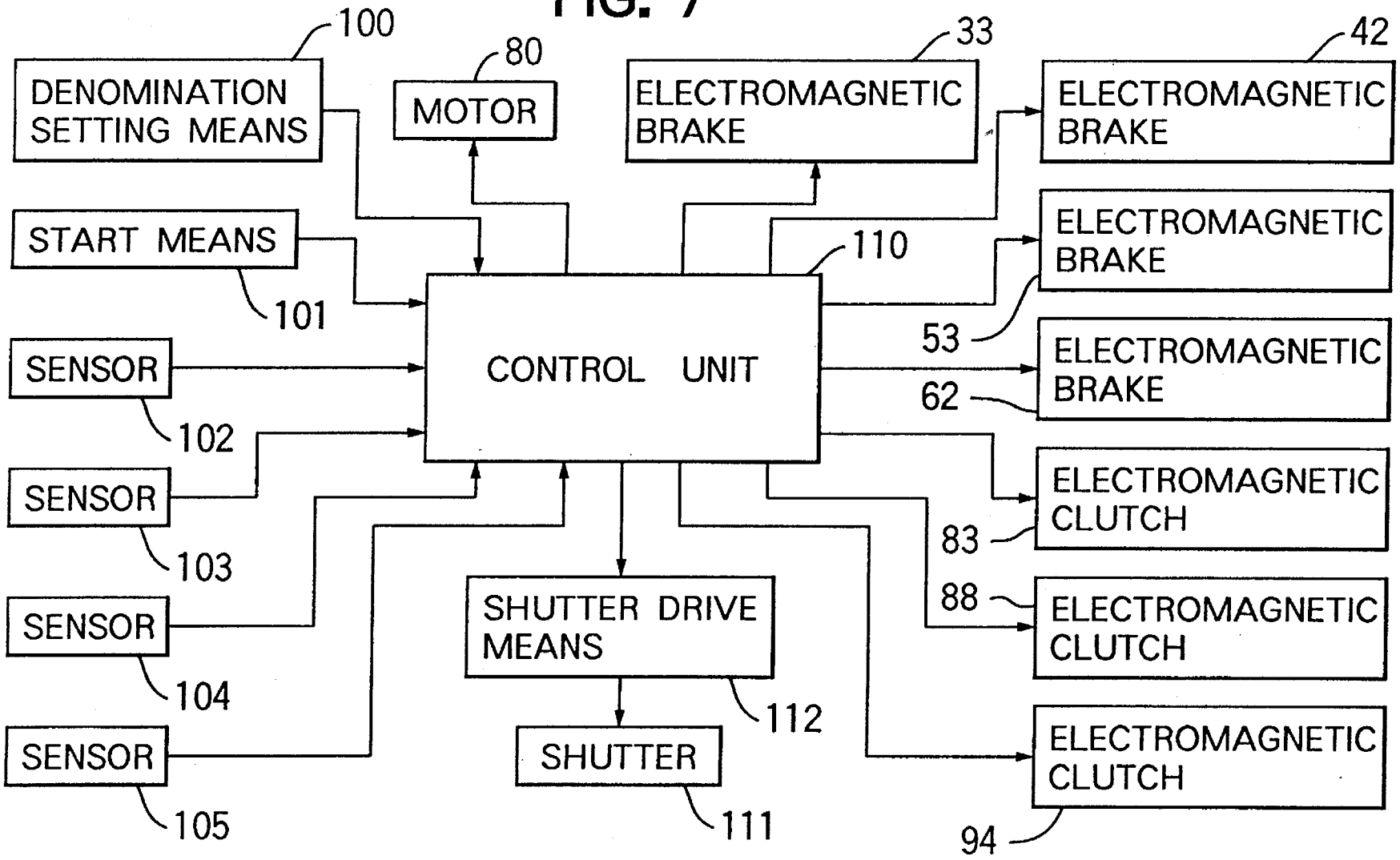
FIG. 7 is a block diagram of an input system, a detection system, a control system and a drive system of a coin wrapping machine provided with a coin wrapping apparatus which is an embodiment of the present invention.

FIG. 7 is a block diagram of an input system, a detection system, a control system and a drive system of a coin wrapping machine provided with a coin wrapping apparatus which is an embodiment of the present invention.

In FIG. 7, the input system of the coin wrapping machine includes a denomination setting means 100 for setting the denomination of coins to be wrapped and a start means 101 for causing the coin wrapping operation to be started. The detection system of the coin wrapping machine includes a sensor 102 for discriminating the denominations of coins and counting the number of coins which have been fed into the coin stacking apparatus, a sensor 103 for detecting the amount of rotation of the drive shaft 37, a sensor 104 for detecting the amount of rotation of the drive shaft 57 and a sensor 105 for detecting the amount of rotation of the drive shaft 95. The control system of the coin wrapping machine includes a control unit 110 which receives a denomination setting signal from the denomination setting means 100, a start signal from the start means 101, coin detection signals and count signals from the sensor 102 and rotation amount detection signals from the sensors 103, 104, 105. The drive system of the coin wrapping machine includes the motor 80, the electromagnetic brakes 33, 42, 53, 62, the electromagnetic clutches 83, 88, 94 and a shutter drive means 112 for opening and closing a shutter 111 provided at the bottom of the coin stacking apparatus (not shown). In response to the input signals, the control unit 110 outputs operation signals or operation stop signals to the motor 80, electromagnetic brakes 33, 42, 53, 62, and the shutter drive means 112 and outputs engagement signals or disengagement signals to the electromagnetic clutches 83, 88, 94.

The thus constituted coin wrapping apparatus which is an embodiment of the present invention wraps a predetermined number of coins in the following manner.

After a coin wrapping operation has been completed, in accordance with the output signals from the control unit 110, the wrapping rollers 1*a*, 1*b*, 1*c* are retracted to the wrapping roller retracted positions determined in accordance with the denomination of the coins to be wrapped and the coin support post 2 is located at the coin support post retracted position. Further, the upper crimp claw 3 and the lower crimp claw 4 are located at the crimp claw retracted positions and the control unit 110 outputs operation signals to the electromagnetic brakes 42, 62 to actuate them for holding the arm 40 and the arm 60 stationary. Disengagement signals are output to the electromagnetic clutches 83, 88, 94.

When the number of coins stacked in a coin stacking apparatus (not shown) reaches a predetermined number, the sensor 102 outputs a wrapping operation start signal to the control unit 110.

When the control unit 110 receives the wrapping operation start signal from the sensor 102, it outputs an operation signal to the motor 80, thereby driving the motor 80 counterclockwise in a horizontal plane.

Simultaneously, the control unit 110 outputs an operation stop signal to the electromagnetic brake 42, an operation signal to the electromagnetic brake 33 and an engagement signal to the electromagnetic clutch 83, thereby engaging the output shaft 81 and the drive shaft 37.

As a result, the driving force of the motor 80 is transmitted to the drive shaft 37 and the sun gear 38 via the output shaft 81 and the electromagnetic clutch 83. Since the rotatable shaft 32 and the arm 34 integrally formed therewith are held stationary by the electromagnetic brake 33, the planetary gears 36*a*, 36*b* do not planetarily move but rotate clockwise in FIG. 2. As a consequence, the internal gear 41 also rotates clockwise and the coin support post arm 43 is swung about the rotatable shaft 32 so that the coin support post 2 is moved toward a location below the central portion of the space between the wrapping rollers 1*a*, 1*b*, 1*c*.

When the control unit 110 judges based upon the amount of rotation of the drive shaft 37 detected by the sensor 103 that the coin support post 2 has been located below the central portion of the space between the wrapping rollers 1*a*, 1*b*, 1*c*, it outputs an operation signal to the electromagnetic brake 42 and an operation stop signal to the electromagnetic brake 33.

As a result, the rotation of the arm 40 and the internal gear 41 formed therein is stopped and the planetary gears 36*a*, 36*b* planetarily move around the sun gear 38 counterclockwise in FIG. 2, whereby the rotatable shaft 32 rotates counterclockwise in FIG. 2 via the arm 34.

As shown in FIG. 6, the external thread formed on the rotatable shaft 32 is a left-hand thread. As the rotatable shaft 32 rotates counterclockwise, therefore, the coin support post arm 43 rises and the coin support post 2 is elevated in the central portion of the space between the wrapping rollers 1*a*, 1*b*, 1*c* toward the coin support post waiting position.

When the control unit 110 judges based upon the amount of rotation of the drive shaft 37 detected by the sensor 103 that the coin support post 2 has reached the coin support post waiting position immediately below the coin stacking apparatus, it outputs an operation stop signal to the motor 80 to stop the coin support post 2 at the coin support post waiting position and outputs an operation signal to the shutter drive means 112 to open the shutter 111 of the coin stacking apparatus, whereby the stacked coins are transferred onto the upper surface of the coin support post 2.

The control unit 110 then outputs an operation signal to the motor 80 to rotate the motor 80 clockwise in the horizontal plane so that the coin support post arm 43 is lowered until the coin support post 2 reaches the coin support post wrapping position.

When the control unit 110 judges based upon the amount of rotation of the drive shaft 37 detected by the sensor 103 that the coin support post 2 has reached the coin support post wrapping position, it outputs an operation stop signal to the motor 80 to stop the motor 80 and outputs an operation signal to the electromagnetic brake 33, thereby stopping the rotation of the rotatable shaft 32. Further, the control unit 110 outputs a disengagement signal to the electromagnetic clutch 83 so as to disengage the output shaft 81 and the drive shaft 37. As a result, the coin support post 2 is held at the coin support post wrapping position, with the stacked coins to be wrapped held on the upper surface thereof.

Then, the control unit 110 outputs an operation signal to the motor 80 so as to drive the motor 80 counterclockwise in the horizontal plane.

Simultaneously, the control unit 110 outputs an engagement signal to the electromagnetic clutch 94.

As a result, the driving force of the motor 80 is transmitted to the drive shaft 95 via the output shaft 81, the pulley 82, the belt 87, the pulley 86, the shaft 85, the pulley 90, the belt 93, the pulley 92, the shaft 91 and the electromagnetic clutch 94, thereby rotating the rotatable shaft 21 via the bevel gears 96, 97. When the motor 80 is rotated counterclockwise in the horizontal plane, the rotatable shaft 21 is rotated clockwise in FIG. 1, thereby moving the wrapping roller spacing adjusting member 23 to the left in FIG. 1 so that the wrapping rollers 1*a*, 1*b*, 1*c* are moved closer to each other until they reach the wrapping roller wrapping positions.

Since a wrapping film (not shown) is fed between the wrapping rollers 1*a*, 1*b*, 1*c* and the stacked coins supported on the upper surface of the coin support post 2 at this time, the stacked coins are held together with the wrapping film by the wrapping rollers 1*a*, 1*b*, 1*c*. Since the wrapping rollers 1*a*, 1*b*, 1*c* are being rotated, the wrapping film is wound around the stacked coins.

When a predetermined length of the wrapping film has been fed toward the wrapping rollers 1*a*, 1*b*, 1*c* the wrapping film is cut by a cutter (not shown) in the well known manner.

At the time the control unit 110 judges based upon the amount of rotation of the drive shaft 95 detected by the sensor 105 that the wrapping rollers 1*a*, 1*b*, 1*c* have reached the wrapping roller wrapping positions, it outputs a disengagement signal to the electromagnetic clutch 94, thereby disengaging the shaft 91 and the drive shaft 95.

Then, the control unit 110 outputs an operation stop signal to the electromagnetic brake 62, outputs an operation signal to the electromagnetic brake 53 and further outputs an engagement signal to the electromagnetic clutch 88.

As a result, the driving force of the motor 80 is transmitted to the drive shaft 57 and the sun gear 58 via the output shaft 81, the pulley 82, the belt 87, the pulley 86, the shaft 85 and the electromagnetic clutch 88.

Since the rotatable shaft 52 and the arm 54 integrally formed therewith are held stationary by the electromagnetic brake 53, the planetary gears 56*a*, 56*b* do not planetarily move but rotate clockwise in FIG. 5. As a consequence, the internal gear 61 also rotates clockwise so as to swing the arms 60 and 67, whereby the lower crimp claw arm 64 and the upper crimp claw arm 63 are swung about the rotatable shaft 52 via the guide rods 66, 65 so that the lower crimp claw 4 and the upper crimp claw 3 are moved toward the top and bottom of the central portion of the space between the wrapping rollers 1*a*, 1*b*, 1*c*, namely, the crimp claw waiting positions.

When the control unit 110 judges based upon the amount of rotation of the drive shaft 57 detected by the sensor 104 that the upper crimp claw 3 and the lower crimp claw 4 have reached the crimp claw waiting positions, it outputs a disengagement signal to the electromagnetic brake 53 and outputs an operation signal to the electromagnetic brake 62.

Consequently, since the rotation of the arm 60 and the internal gear 61 therein is stopped, the planetary gears 56*a*, 56*b* move planetarily counterclockwise around the sun gear 58 and the rotatable shaft 52 is rotated counterclockwise in FIG. 4 via the arm 54.

Since, as shown in FIG. 6, the upper portion of the rotatable shaft 52 is formed with a right-hand thread and the lower portion of the rotatable shaft 52 is formed with a left-hand thread, the counterclockwise rotation of the rotatable shaft 52 raises the lower elevator member 69 and lowers the upper elevator member 68.

Therefore, the lower crimp claw arm 64 is elevated via the tension springs 73, 71 and the upper crimp claw arm 63 is lowered via the tension springs 72, 70.

When the control unit 110 judges based upon the amount of rotation of the drive shaft 57 detected by the sensor 104 that the upper crimp claw 3 and the lower crimp claw 4 have reached the crimping positions, it outputs an operation stop signal to the motor 80 to stop it.

As a result, the upper and lower end portions of the wrapping film wound around the stacked coins which are being rotated by the wrapping rollers 1*a*, 1*b*, 1*c* are crimped by the upper crimp claw 3 and the lower crimp claw 4.

Then, when the control unit 110 judges that a predetermined time has passed and that the upper and lower end portions of the wrapping film wound around the stacked coins 1*a*, 1*b*, 1*c* have been crimped by the upper crimp claw 3 and the lower crimp claw 4 to produce a wrapped coin roll, it outputs an operation signal to the motor 80, thereby rotating it clockwise in the horizontal plane. As a result, the upper crimp claw 3 begins to elevate and the lower crimp claw 4 begins to lower.

Simultaneously, the control unit 110 outputs an operation stop signal to the electromagnetic brake 33 and outputs an engagement signal to the electromagnetic clutch 83. As a result, the coin support post 2 begins to be lowered from the coin support post wrapping position.

When the control unit 110 judges based upon the amount of rotation of the drive shaft 57 detected by the sensor 104 that the upper crimp claw 3 and the lower crimp claw 4 have reached the crimp claw waiting positions, it outputs an operation stop signal to the electromagnetic brake 62 and outputs an operation signal to the electromagnetic brake 53.

Consequently, the driving force of the motor 80 is transmitted to the sun gear 58 and since the rotatable shaft 52 and the arm 54 integrally formed therewith are held stationary, the planetary gears 56*a*, 56*b* do not planetarily move but rotate counterclockwise in FIG. 5. As a result, the internal gear 61 also rotates counterclockwise so as to swing the arms 60 and 67, whereby the lower crimp claw arm 64 and the upper crimp claw arm 63 are swung about the rotatable shaft 52 via the guide rods 66, 65 so that lower crimp claw 4 and the upper crimp claw 3 are moved toward the top and bottom of the central portion of the space between the wrapping rollers 1*a*, 1*b*, 1*c*, namely, from the crimping positions to the crimp claw retracted positions.

When the control unit 110 judges based upon the amount of rotation of the drive shaft 37 detected by the sensor 103 that the coin support post 2 has been lowered completely, it outputs an operation stop signal to the electromagnetic brake 42 and outputs an operation signal to the electromagnetic brake 33.

As a result, the clockwise driving force of the motor 80 is transmitted to the sun gear 38. Since the rotatable shaft 32 and the arm 34 integrally formed therewith are held stationary by the electromagnetic brake 33, the planetary gears 36*a*, 36*b* do not planetarily move but rotate counterclockwise in FIG. 2. As a consequence, the internal gear 41 also rotates counterclockwise, whereby the coin support post arm 43 is swung about the rotatable shaft 32 via the arm 40 so that the coin support post 2 is moved from the bottom of the central portion of the space between the wrapping rollers 1*a*, 1*b*, 1*c* toward the coin support post retracted position.

When the control unit 110 judges based upon the amount of rotation of the drive shaft 37 detected by the sensor 103 and the amount of rotation of the shaft 85 detected by the sensor 104 that the coin support post 2 has reached the coin support post retracted position and that the upper Crimp claw 3 and the lower crimp claw 4 have reached the crimp claw retracted positions, it outputs operation signals to the electromagnetic brake 42 and the electromagnetic brake 62 and outputs disengagement signals to the electromagnetic clutch 83 and the electromagnetic clutch 88, thereby holding the coin support post 2 at the coin support post retracted position and holding the upper crimp claw 3 and the lower crimp claw 4 at the crimp claw retracted positions.

Then, the control unit 110 outputs an engagement signal to the electromagnetic clutch 94 to connect the shaft 91 and the drive shaft 95, thereby rotating the rotatable shaft 21 via the bevel gears 96, 97.

As a result, when the driving force of the motor 80 has been transmitted to the rotatable shaft 21 via the output shaft 81, the pulley 82, the belt 87, the pulley 86, the shaft 85, the pulley 90, the belt 93, the pulley 92, the shaft 91, the electromagnetic clutch 94 and bevel gears 96, 97, the rotatable shaft 21 is rotated counterclockwise in FIG. 1 and the wrapping roller spacing adjusting member 23 is moved to the right in FIG. 1 along the rotatable shaft 21. Consequently, the wrapping rollers 1*a*, 1*b*, 1*c* are moved apart from each other so as to be moved from the wrapping roller wrapping positions to the wrapping roller retracted positions.

Therefore, the wrapped coin roll which had been held by the wrapping rollers 1*a*, 1*b*, 1*c* is no longer held thereby and falls by its own weight to be collected in a wrapped coin roll collecting box (not shown).

When the control unit 110 judges based upon the amount of rotation of the drive shaft 95 detected by the sensor 105 that the wrapping rollers 1*a*, 1*b*, 1*c* have reached the wrapping roller retracted positions, it outputs an operation stop signal to the motor 80 to stop it and outputs a disengagement signal to the electromagnetic clutch 94 to disconnect the shaft 91 and the drive shaft 95.

Thus, one cycle of the wrapping operation is completed.

According to this embodiment, the coin support post 2 can be operated to hold the stacked coins at a desired position in the vertical direction by setting the amount of rotation of the rotatable shaft 32 according to the denomination of the coins to be wrapped and the wrapping rollers 1*a*, 1*b*, 1*c* can be operated to wrap the stacked coins in a desired manner by setting the amount of rotation of the rotatable shaft 21. As these operation can be conducted without numerous cam mechanisms and complicated link mechanisms, the structure of the coin wrapping machine can be simplified and the coin wrapping machine can be made compact.

Figure 8:
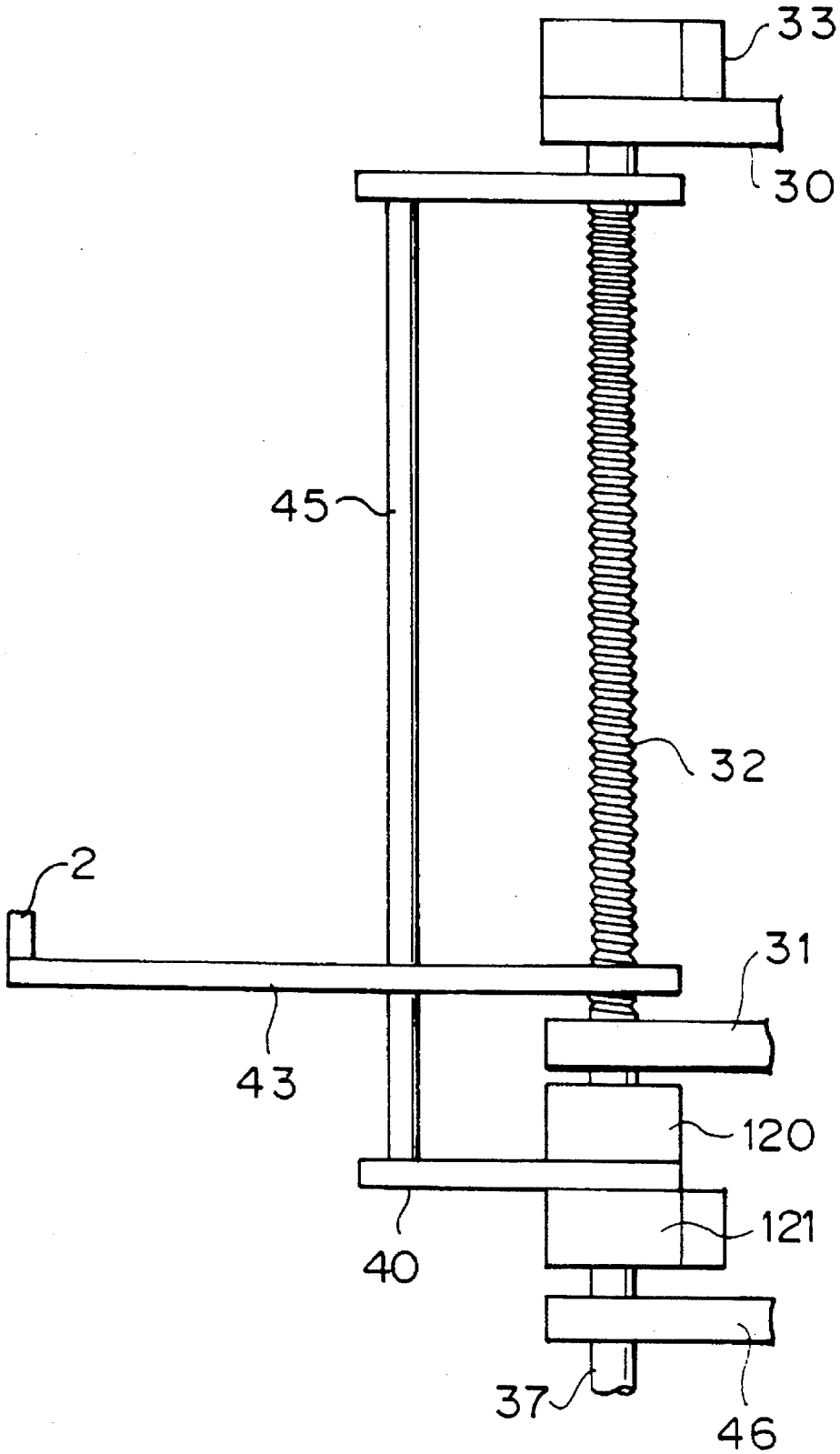
FIG. 8 is a schematic front view showing a coin support post moving mechanism of a coin wrapping apparatus which is another embodiment of the present invention.

FIG. 8 is a schematic front view showing a coin support post moving mechanism of a coin wrapping apparatus which is another embodiment of the present invention.

In the coin support post moving mechanism 11 according to the embodiment of FIGS. 1 to 7, the driving force of the motor 80 is selectively transmitted to the rotatable shaft 32 or the coin support post arm 43 by a planetary gear mechanism. In this embodiment, however, an electromagnetic clutch is used instead of the planetary gear mechanism.

Figure 9:
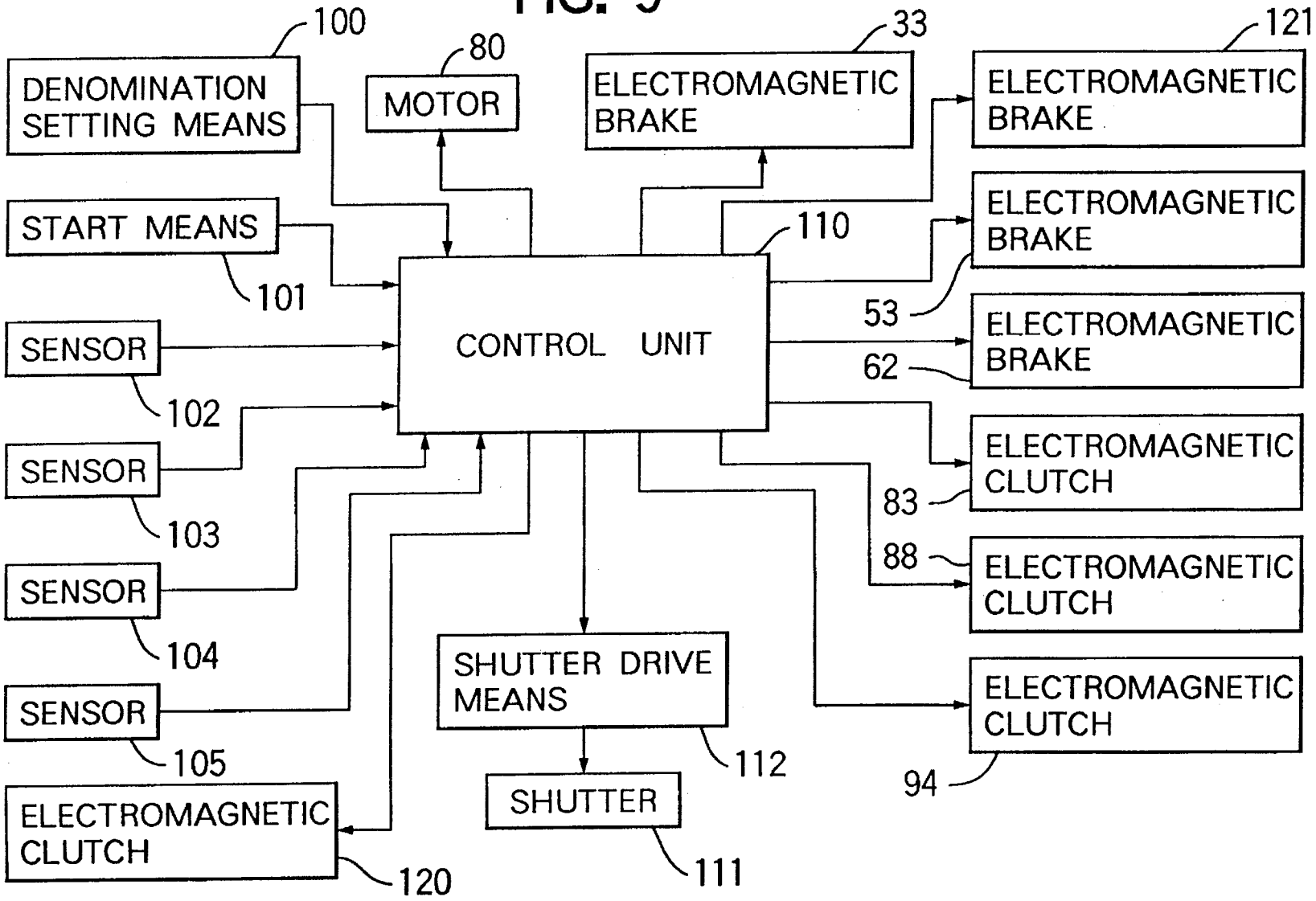
FIG. 9 is a block diagram of an input system, a detection system, a control system and a drive system of a coin wrapping machine provided with the coin support post moving mechanism shown in FIG. 8.

FIG. 9 is a block diagram of an input system, a detection system, a control system and a drive system of a coin wrapping machine provided with such a coin support post moving mechanism.

In FIGS. 8 and 9, an electromagnetic clutch 120 and an electromagnetic brake 121 are provided on the rotatable shaft 32 below the support frame 31 for supporting the rotatable shaft 32 in the coin support post moving mechanism according to this embodiment.

The electromagnetic brake 121 is adapted for preventing the arm 40 from rotating in the horizontal plane relative to the rotatable shaft 32 when an operation signal is input from the control unit 110 and permitting the arm 40 to rotate in the horizontal plane relative to the rotatable shaft 32 when an operation stop signal is input. The electromagnetic clutch 120 is adapted for connecting the drive shaft 37 and the rotatable shaft 32 when an engagement signal is input from the control unit 110 and disconnecting the drive shaft 37 and the rotatable shaft 32 when a disengagement signal is input.

Therefore, when the control unit 110 receives a wrapping operation start signal from the sensor 102, it outputs an operation signal to the motor 80 to drive it counterclockwise in the horizontal plane.

Simultaneously, the control unit 110 outputs an operation signal to the electromagnetic brake 121. At this time, a disengagement signal has been output to the electromagnetic clutch 120 and the drive shaft 37 and the rotatable shaft 32 are disconnected.

As a consequence, when the motor 80 is driven, the rotatable shaft 32 is not rotated but only the arm 40 is swung, whereby the coin support post arm 43 is swung until the coin support post 2 is located below the central portion of the space between the wrapping rollers 1*a*, 1*b*, 1*c*.

When the control unit 110 judges based upon the amount of rotation of the drive shaft 37 detected by the sensor 103 that the coin support post 2 has reached the location below the central portion of the space between the wrapping rollers 1*a*, 1*b*, 1*c*, it outputs an operation stop signal to the electromagnetic brake 121 and outputs an engagement signal to the electromagnetic clutch 120. As a result, the drive shaft 37 and the rotatable shaft 32 are connected and the rotatable shaft 32 becomes rotatable independently of the swinging of the arm 40.

Therefore, as the rotatable shaft 32 rotates, the coin support post arm 43 is elevated and when the coin support post 2 has reached the coin support post waiting position, the control unit 110 outputs an operation stop signal to the motor 80 and the coin support post 2 is stopped at the coin support post waiting position.

When the coin support post 2 has received the stacked coins from a coin stacking apparatus (not shown), the control unit 110 outputs an operation signal to the motor 80 to drive it clockwise in the horizontal plane.

As a result, as the rotatable shaft 32 rotates, the coin support post arm 43 is lowered. When the coin support post 2 has reached the coin support post wrapping position, the control unit 110 outputs an operation stop signal to the motor 80 and the coin support post 2 is stopped at the coin support post wrapping position.

Then, in a similar manner to the previous embodiment, the wrapping rollers 1*a*, 1*b*, 1*c* are moved to the wrapping roller wrapping positions to wrap the stacked coins and when the upper and lower end portions of the wrapping film have been crimped by the upper crimp claw 3 and the lower crimp claw 4 and a wrapped coin roll has been produced, the control unit 110 outputs an operation signal to the motor 80 to drive it clockwise in the horizontal plane, outputs an operation signal to the electromagnetic brake 121 and outputs a disengagement signal to the electromagnetic clutch 120.

As a consequence, only the arm 40 is swung to swing the coin support post arm 43 until the coin support post 2 has reached the coin support post retracted position.

Other operations are similar to those in the previous embodiment.

According to this embodiment, since the coin support post 2 can be moved without a planetary gear mechanism, it is possible to wrap the stacked coins with a mechanism of simpler structure.

Figure 10:
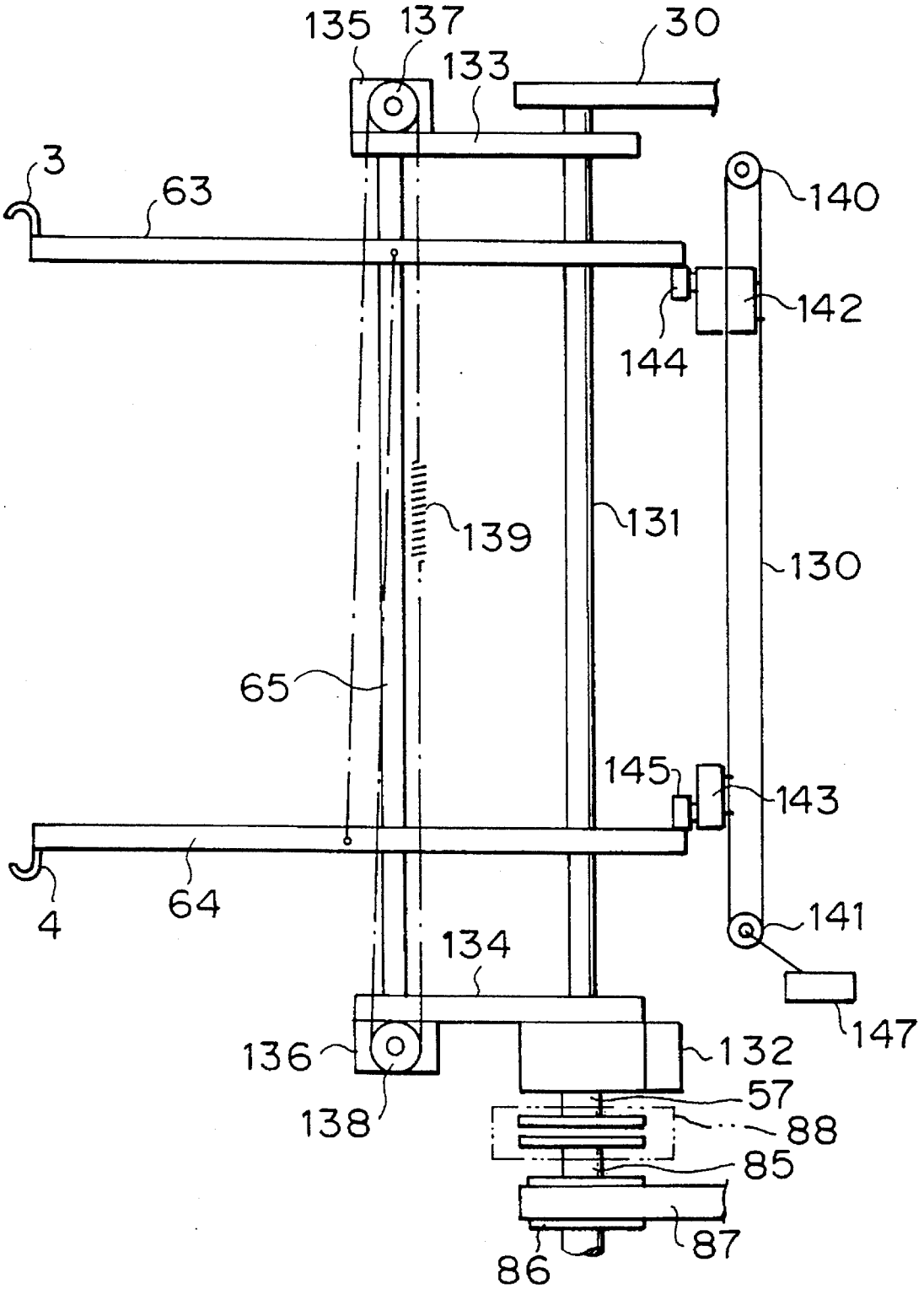
FIG. 10 is a schematic front view showing a crimp claw moving mechanism of a coin wrapping apparatus which is a further embodiment of the present invention.

FIG. 10 is a schematic front view showing a crimp claw moving mechanism of a coin wrapping apparatus which is a further embodiment of the present invention.

In the crimp claw moving mechanism shown in FIG. 10, the rotatable shaft is not formed with a thread and the upper crimp claw arm 63 and the lower crimp claw arm 64 are moved in the vertical direction by an endless belt 130.

More specifically, the crimp claw moving mechanism 12 includes a rotatable shaft 131 having a smooth surface and rotatably supported by the support frame 30, the shaft 85 connected to the output shaft 81 of the motor 80 via the belt 87 and the pulley 86, an electromagnetic brake 132 provided on the shaft 85 for preventing a support member 134 integrally formed with the rotatable shaft 131 from rotating in the horizontal plane, the upper crimp claw arm 63 and the lower crimp claw arm 64 through which the guide rod 65 and the rotatable shaft 131 extend, support members 133, 134 fixed to the guide rod 65 and through which the rotatable shaft 131 extends, blocks 135, 136 respectively provided on the support members 133, 134, rollers 137, 138 rotatably supported by the blocks 135, 136, a tension spring 139 engaged between the rollers 137, 138 with one end portion thereof fixed to the upper crimp claw arm 63 and the other end portion thereof fixed to the lower crimp claw arm 64., an endless belt 130 entrained around pulleys 140, 141, mounted members 142, 143 mounted on the endless belt 130, an abutting member 144 abutting against the lower surface of the upper crimp claw arm 63 via the mounting member 142, an abutting member 145 abutting against the upper surface of the lower crimp claw arm 64 via the mounting member 143, and a motor 147 for rotating the pulley 140.

Figure 11:
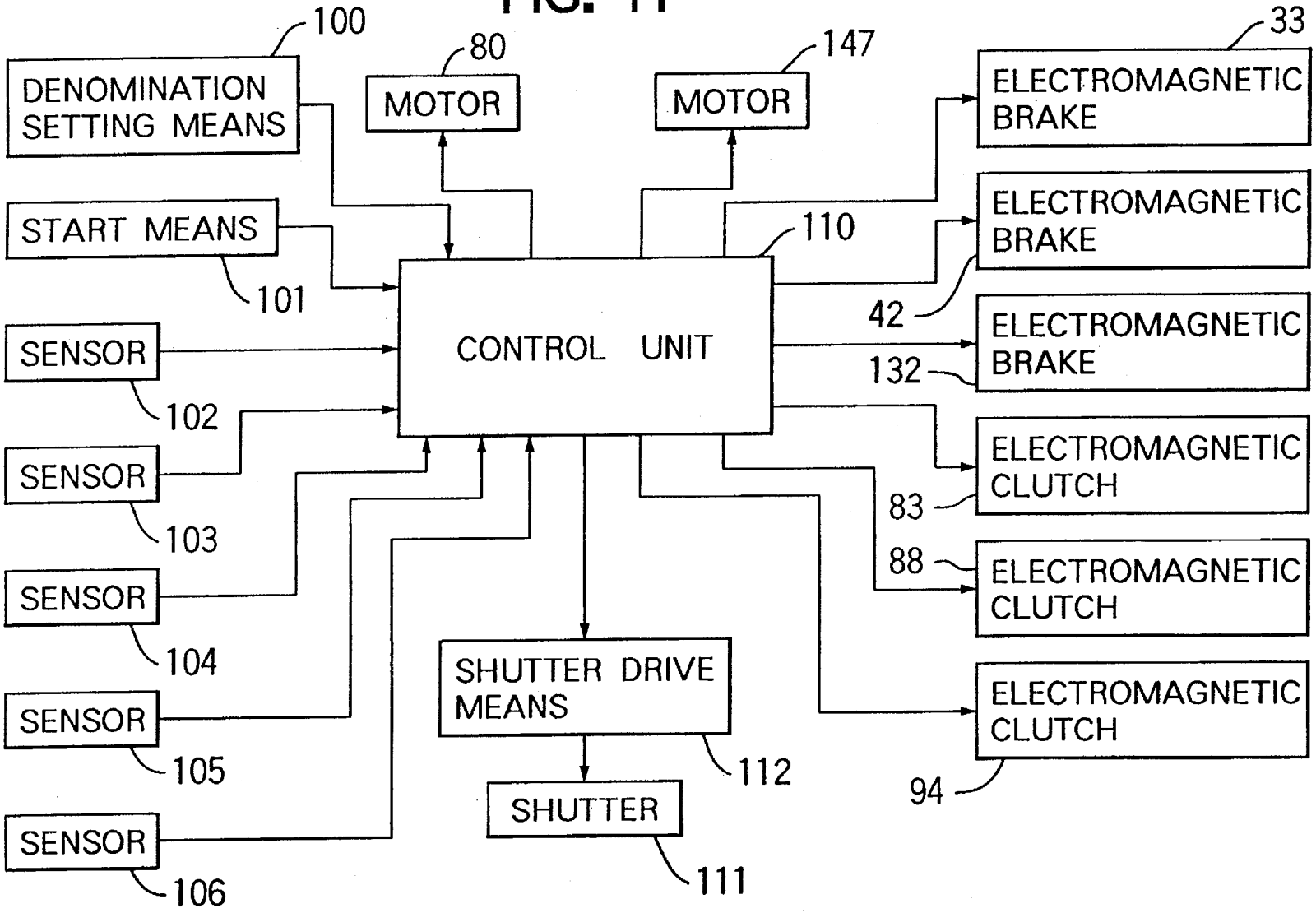
FIG. 11 is a block diagram of an input system, a detection system, a control system and a drive system of a coin wrapping machine provided with the crimp claw moving mechanism shown in FIG. 10.

FIG. 11 is a block diagram of an input system, a detection system, a control system and a drive system of a coin wrapping machine provided with such a crimp claw moving mechanism. The sensor 106 in FIG. 11 is adapted for detecting the amount of rotation of the pulley 140.

In the thus constituted crimp claw moving mechanism 12, after the coin support post 2 has been held at the coin support post wrapping position and the wrapping rollers 1*a*, 1*b*, 1*c* have been moved to the wrapping roller wrapping positions, the control unit 110 outputs an engagement signal to the electromagnetic clutch 88 and outputs an operation stop signal to the electromagnetic brake 132.

As a result, the driving force of the motor 80 is transmitted to the shaft 85 via the output shaft 81, the pulley 82, the belt 87, the pulley 86 and the electromagnetic clutch 88. Since the electromagnetic brake 132 is not operative, the support members 133, 134 are swung, whereby the upper crimp claw arm 63 and the lower crimp claw arm 64 are swung so that the upper crimp claw 3 and the lower crimp claw 4 can be moved to the crimp claw waiting positions.

When the control unit 110 judges based upon the amount of rotation of the drive shaft 57 detected by the sensor 104 that the upper crimp claw 3 and the lower crimp claw 4 have reached the crimp claw waiting positions, it outputs an operation signal to the electromagnetic brake 132 to stop the horizontal movement of the upper crimp claw 3 and the lower crimp claw 4 and outputs an operation signal to the motor 147 to drive it, thereby rotating the pulley 140 clockwise in FIG. 10. As a result, since the endless belt 130 is driven, the mounting member 142 and the abutting member 144 are moved downwardly and the mounting member 143 and the abutting member 145 are moved upwardly. Further, the upper crimp claw 63 is moved downwardly and the lower crimp claw arm 64 is moved upwardly until the upper crimp claw 3 and the lower crimp claw 4 have reached the crimping positions.

When the control unit 110 judges based upon the amount of rotation of the pulley 140 detected by the sensor 106 that the upper crimp claw 3 and the lower crimp claw 4 have reached the crimping positions, it outputs an operation stop signal to the motor 147 to hold the upper crimp claw 3 and the lower crimp claw 4 at the crimping positions.

When the control unit 110 judges that a predetermined time has passed and that the upper and lower end portions of the wrapping film wound around the stacked coins have been crimped, it outputs an operation signal to the motor 147 to drive it so that the pulley 140 is rotated counterclockwise in FIG. 10.

Consequently, the endless belt 130 is driven in the reverse direction and the upper crimp claw 3 and the lower crimp claw 4 are moved to the crimp claw waiting positions.

When the control unit 110 judges based upon the amount of rotation of the pulley 140 detected by the sensor 106 that the upper crimp claw 3 and the lower crimp claw 4 have reached the crimp claw waiting positions, it outputs an operation stop signal to the motor 147 and outputs an operation stop signal to the electromagnetic brake 132. Further, the control unit 110 outputs an operation signal to the motor 80 to drive it counterclockwise in the horizontal plane.

As a result, the support members 133, 134, the upper crimp claw arm 63 and the lower crimp claw arm 64 are swung so that the upper crimp claw 3 and the lower crimp claw 4 are moved to the crimp claw retracted positions.

Then, similarly to the embodiment shown in FIGS. 1 to 7, the wrapping rollers 1*a*, 1*b*, 1*c* are moved to the wrapping roller retracted positions and one cycle of the wrapping operation is completed.

According to this embodiment, since the stacked coins can be wrapped with a mechanism of simple structure without use of numerous cams and complicated link mechanisms, it is possible to make the coin wrapping machine compact.

The present invention has thus been shown and described with reference to specific embodiments. However, it should be noted that the present invention is in no way limited to the details of the described arrangements but changes and modifications may be made without departing from the scope of the appended claims.

For example, in the embodiments shown in FIGS. 1 to 9, although a single motor 80 drives the wrapping roller moving mechanism 10, the coin support post moving mechanism 11 and the crimp claw moving mechanism 12, a motor may be associated with, and drive means constituted for, each of these mechanisms.

Moreover, in the embodiment shown in FIGS. 8 and 9, although only the planetary gear mechanism of the coin support post moving mechanism 11 is replaced by the electromagnetic clutch 120 and the electromagnetic brake 121, the planetary gear mechanism can be used in the coin support post moving mechanism 11 and the planetary gear mechanism of the crimp claw moving mechanism 12 may be replaced by the electromagnetic clutch 120 and the electromagnetic brake 121. Further, an electromagnetic clutch and an electromagnetic brake may be used instead of the planetary gear mechanisms of both the coin support post moving mechanism 11 and the crimp claw moving mechanism 12.

Furthermore, in the embodiment shown in FIGS. 10 and 11, although only the upper and lower crimp claws 3 and 4 of the crimp claw moving mechanism 12 are moved vertically by the endless belt 130, it is possible also to move the coin support post 2 of the coin support post moving mechanism 11 vertically by an endless belt. Further, a chain, wire or the like can be used instead of the endless belt 130.

Moreover, in the embodiment shown in FIGS. 10 and 11, although mounting means 142, 143 are mounted on a single endless belt 130 and the upper crimp claw 3 and the lower crimp claw 4 are moved in the vertical direction via the abutting members 144, 145, it is possible to provide two independent belts and mount a mounting member one each of the endless belts, thereby moving the upper crimp claw 3 and the lower crimp claw 4 vertically to adjust the crimp claw waiting positions. In this case also, a chain, wire or the like can be used instead of the endless belt 130.

Further, in the specification and the appended claims, the respective means need not necessarily be physical means and arrangements whereby the functions of the respective means are accomplished by software fall within the scope of the present invention. In addition, the function of a single means may be accomplished by two or more physical means and the functions of two or more means may be accomplished by a single physical means.

According to the present invention, it is possible to provide a compact coin wrapping apparatus which can wrap a predetermined number of coins in a desired manner with a mechanism of simple structure.

We claim:

1. A coin wrapping apparatus comprising:

a coin support member adapted to support stacked coins;

a coin support member moving mechanism for moving the coin support member;

a plurality of wrapping rollers adapted to wind a wrapping film around the stacked coins supported by the coin support member;

a wrapping roller moving mechanism for moving the plurality of wrapping rollers; and a crimp claw moving mechanism for moving a pair of crimp claws adapted to crimp upper and lower end portions of the wrapping film wound around the stacked coins by the plurality of wrapping rollers to produce a wrapped coin roll having a predetermined number of coins, the coin support member moving mechanism comprising a first coin support member moving means for moving the coin support member vertically, a second coin support member moving means for moving the coin support member horizontally and a first switching means for selectively actuating the first coin support member moving means and the second coin support member moving means, the crimp claws moving mechanism comprising a first crimp claw moving means for moving the pair of crimp claws vertically, a second crimp claw moving means for moving the pair of crimp claws horizontally and a second switching means for selectively actuating the first crimp claw moving means and the second crimp claw moving means, the wrapping roller moving mechanism comprising a rotatable shaft having an external thread and a wrapping roller spacing adjusting means having a bore whose inner surface includes an internal thread engages the external thread on the rotatable shaft for moving the wrapping roller spacing adjusting means along the rotatable shaft as the rotatable shaft rotates and link means for moving the plurality of wrapping rollers in accordance with the movement of the wrapping roller spacing adjusting means along the rotatable shaft.

2. A coin wrapping apparatus in accordance with claim 1, wherein the coin support member moving mechanism comprises:

a coin support arm member having a bore defined therein, the bore having a threaded inner surface and the coin support member being provided on one end portion of the coin support arm member, wherein the first coin support member moving means comprises a rotatable shaft having an external thread that engages the internal thread of the coin support arm member, and wherein the second coin support member moving means comprises swing means swingable about the rotatable shaft together with the coin support arm member so that the first switching means selectively swings the swing means to move the coin support arm member horizontally or rotates the rotatable shaft to move the coin support arm member vertically.

3. A coin wrapping apparatus in accordance with claim 1, wherein the crimp claw moving mechanism comprises an upper crimp claw arm member having a bore defined therein, the bore having a threaded inner surface, an upper crimp claw formed at one end portion of the upper crimp claw are member, a lower crimp claw arm member having a bore defined therein, the bore having a threaded inner surface and a lower crimp claw provided at a one end portion of the lower crimp claw are member, the first crimp claw moving means comprises a rotatable shaft having an external thread which engages the internal threads of the upper crimp claw arm member and the internal threads of the lower crimp claw arm member and which is opposite in a helical direction between the upper and lower portions thereof, and the second crimp claw moving means comprises a swing member swingable about the rotatable shaft together with the upper crimp claw arm member and the lower crimp claw arm member so that the second switching means selectively swings the swing means to move the upper crimp claw arm member and the lower crimp claw arm member horizontally or rotates the rotatable shaft to move the upper crimp claw arm member and the lower crimp claw arm member vertically.

4. A coin wrapping apparatus in accordance with claim 1 wherein the first crimp claw moving means comprises an endless driving force transmitting means for moving the upper crimp claw arm member and the lower crimp claw arm member vertically.

5. A coin wrapping apparatus in accordance with claim 2, wherein the crimp claw moving mechanism comprises an upper crimp claw arm member having a bore defined therein, the bore having a threaded inner surface, an upper crimp claw provided at one end portion of the upper crimp claw arm member, a lower crimp claw arm member having a bore inner surface and a lower crimp claw provided at one end portion of the lower crimp claw arm member, wherein the first crimp claw moving means comprises a rotatable shaft having an external thread which engages the internal threads of the upper crimp claw arm member and the internal threads of the lower crimp claw arm member and which is opposite in a helical direction between the upper and lower portions thereof, and wherein the second crimp claw moving means comprises a swing member swingable about the rotatable shaft together with the upper crimp claw arm member and the lower crimp claw arm member so that the second switching means selectively swings the swing means to move the upper crimp claw arm member and the lower crimp claw arm member horizontally or rotates the rotatable shaft to move the upper crimp claw arm member and the lower crimp claw arm member vertically.

6. A coin wrapping apparatus in accordance with claim 2 wherein at least one of the first switching means and the second switching means comprises a planetary gear mechanism.

7. A coin wrapping apparatus in accordance with claim 2 wherein at least one of the first switching means and the second switching means comprises clutch means and brake means.

8. A coin wrapping apparatus in accordance with claim 3 wherein at least one of the first switching means and the second switching means comprises a planetary gear mechanism.

9. A coin wrapping apparatus in accordance with claim 3 wherein at least one of the first switching means and the second switching means comprises clutch means and brake means.

10. A coin wrapping apparatus in accordance with claim 3 wherein the first crimp claw moving means comprises an endless driving force transmitting means for moving the upper crimp claw arm member and the lower crimp claw arm member vertically.

11. A coin wrapping apparatus in accordance with claim 5 wherein at least one of the first switching means and the second switching means comprises a planetary gear mechanism.

12. A coin wrapping apparatus in accordance with claim 5 wherein at least one of the first switching means and the second switching means comprises clutch means and brake means.

13. A coin wrapping apparatus in accordance with claim 5 wherein the first crimp claw moving means comprises an endless driving force transmitting means for moving the upper crimp claw arm member and the lower crimp claw arm member vertically.

14. A coin wrapping apparatus in accordance with claim 6 wherein the first crimp claw moving means comprises an endless driving force transmitting means for moving the upper crimp claw arm member and the lower crimp claw arm member vertically.

15. A coin wrapping apparatus in accordance with claim 8 wherein the first crimp claw moving means comprises an endless driving force transmitting means for moving the upper crimp claw arm member and the lower crimp claw arm member vertically.

16. A coin wrapping apparatus in accordance with claim 7 wherein the first crimp claw moving means comprises an endless driving force transmitting means for moving the upper crimp claw arm member and the lower crimp claw arm member vertically.

17. A coin wrapping apparatus in accordance with claim 9 wherein the first crimp claw moving means comprises an endless driving force transmitting means for moving the upper crimp claw arm member and the lower crimp claw arm member vertically.

18. A coin wrapping apparatus in accordance with claim 11 wherein the first crimp claw moving means comprises an endless driving force transmitting means for moving the upper crimp claw arm member and the lower crimp claw arm member vertically.

19. A coin wrapping apparatus in accordance with claim 12 wherein the first crimp claw moving means comprises an endless driving force transmitting means for moving the upper crimp claw arm member and the lower crimp claw arm member vertically.

* * * * *